US005561862A

United States Patent [19]

Flores, Sr.

[11] Patent Number: 5,561,862

[45] Date of Patent: Oct. 8, 1996

[54] RIGID HELMET HAVING AIR BLOWING SYSTEM

[76] Inventor: Reynaldo Flores, Sr., 1235 Threadneedle, Beaumont, Tex. 77705

[21] Appl. No.: 502,372

[22] Filed: Jul. 14, 1995

[51] Int. Cl.[6] ..... A42B 3/28

[52] U.S. Cl. ..... 2/171.3; 2/422

[58] Field of Search ..... 2/410, 422, 436, 2/8, 171.3, 906, 209.13, DIG. 1, 424; 416/63

[56] References Cited

U.S. PATENT DOCUMENTS

| | | | |
|---|---|---|---|
| 3,168,748 | 2/1965 | Limberg | 2/171.3 |
| 3,735,423 | 5/1973 | Droz | 2/171.3 |
| 3,813,696 | 6/1974 | Yeager | 2/171.3 |
| 3,881,198 | 5/1975 | Waters | 2/171.3 |
| 3,881,478 | 5/1975 | Rosendahl et al. | 2/171.3 |
| 4,141,083 | 2/1979 | Waters | 2/171.3 |
| 4,546,496 | 10/1985 | Lewis | 2/171.3 |
| 4,680,815 | 7/1987 | Hirsch et al. | 2/171.3 |
| 4,893,356 | 1/1990 | Waters | 2/171.3 |
| 5,085,231 | 2/1992 | Johnson | 2/171.3 |
| 5,123,114 | 6/1992 | Desanti | 2/8 |

*Primary Examiner*—Michael A. Neas

*Attorney, Agent, or Firm*—Bush, Moseley, Riddle & Jackson

[57] ABSTRACT

A helmet having an electrically energized air blowing system for discharging a broad curtain of flowing air along the face of the user for cooling and comfort. The helmet includes a rigid crown section to which is integrally connected a visor and is provided with a vent housing located externally of the domed shell of the helmet and having an air flow chamber terminating at a narrow transverse discharge opening through the helmet visor near the juncture of the visor and the domed shell. An electrically energized fan is mounted within the upper portion of the vent housing and is powered by an electrical circuit having a dry cell battery via manual actuation of an on/off switch. The motorized fan directs a downward flow of air through the flow passage of the vent housing which increases in velocity from the housing inlet to the discharge opening of the housing so that maximum air flow velocity is achieved at the discharge opening.

18 Claims, 2 Drawing Sheets

RIGID HELMET HAVING AIR BLOWING SYSTEM

FIELD OF THE INVENTION

This invention relates generally to head covering devices such as hats, helmets, safety type hard hats, etc. which are provided for battery powered motor operated blowing of air for the purpose of cooling the head of the user. More specifically, the present invention is directed to a helmet construction having a rounded shell having an integral visor or bill and having an air ducting system provided with a battery powered fan and having a vent housing terminating in an elongate, curved air discharge slot defined in the visor or bill and arranged for directing a broad curtain of flowing air over the face of the user to provide cooling for the face. Even more specifically the present invention concerns a rigid type helmet construction having an air inlet, air conducting vent and air discharge opening being arranged to provide a greater velocity of air discharge as compared with air being moved through the air inlet by a motor operated fan.

BACKGROUND OF THE INVENTION

Under circumstances where individuals such as workers, sports spectators and the like are present in a warm environment such as when out of doors in bright sunshine those persons can become quite uncomfortable especially in the region of the head. Since a protective hard hat for workers is usually essential for safety it should not be taken off for extended periods in the working environment to provide for cooling of the head and face of the user. There is therefore often a need to compensate for the hot conditions of the environment by providing an air blowing system for liberating heat from about the user's head for the purpose of cooling while allowing the user to continuously wear the hard hat or helmet.

Under circumstances where the user is a worker, working in hot or otherwise inclement conditions, though motorized cooling is desired for the safety hat of the user nevertheless it is necessary to maintain the impact resistant structural integrity of the hard hat in order to maintain the integrity of the head protection that is needed by the worker. For this reason it is highly desirable that the domed shell of the hard hat not be perforated, cut or altered in any manner that could weaken it.

In the past, safety type helmets for workers have been developed which employ an air blowing system particularly for cooling the head of the user and also for cooling the face of the user. One example of air blowing type safety hard hats is indicated by U.S. Pat. No. 4,893,356 of Waters which employs a hard hat 14 having its frontal portion cut away as shown at 16 so that a motorized fan mounted externally of the hard hat can blow air through the opening 16 for cooling the head of the user. Since the cut away portion is for the most part defined in the front wall of the domed protective shell portion of the hard hat, the structural integrity of the hard hat is materially decreased. Consequently the type of air blowing hard hat construction shown in FIG. 1 of the patent to Waters would not likely be acceptable because the hard hat is materially weakened. Other hats, including hard hats that are provided with motor operated blowing systems for the purpose of cooling, are indicated by U.S. Pat. Nos. 3,168,748 of Limberg, 3,881,198 of Waters, 4,141,083 of Waters, 4,680,815 of Hirsch, et al., 4,546,496 of Lewis, 5,085,231 of Johnson. None of the prior art patents both provide air blowing systems for safety type hard hats or helmets which maintain the structural integrity of the domed shell portion of the helmet while at the same time providing for refreshing and cooling flow of air downwardly along the face of the user for the purpose of cooling. Further, none of the prior art references disclose or inherently suggest a motorized fan operated air blowing system for a hard hat or rigid helmet which provides an air ducting system having an inlet and a narrow, elongate discharge slot for directing air downwardly along the front portion of the shell of the helmet but exteriorally of the shell for a curtain of flowing air along the face of the user. Even further, none of the prior art references disclose or suggest an air blowing system having an air inlet through which air is drawn by a motor operated fan and an air discharge outlet wherein the velocity of air being discharged from the outlet is greater than the velocity of air being drawn through the inlet by the fan mechanism by virtue of a venturi effect that is developed by the configuration of the air flow passage.

SUMMARY OF THE INVENTION

It is a principal feature of the present invention to provide a novel safety type hard hat or rigid sports spectator helmet having a rigid domed shell portion to provide protective covering for the head of the user having a visor portion which is integral with the shell portion to provide the user with efficient safety protection and which is further provided with an air blowing system located externally of the rigid domed head covering shell portion of the hard hat or helmet and which is provided with a motorized air blowing and ducting system for directing a broad curtain-like flow of air over the face of the user.

It is another feature of the present invention to provide a novel motorized air blowing safety helmet or hard hat having a vent housing which defines an air flow passage or duct which is mounted to or extends from the frontal portion of the head covering protective rigid domed shell of the hard hat or helmet and which has an upwardly directed inlet opening of large dimension through which air is drawn and further having an elongate, narrow air discharge slot which is formed in the visor portion of the helmet to provide for the continuous flow of a curtain of air downwardly over the face of the user while the hard hat is being worn.

It is even a further feature of this invention to provide a novel air blowing hard hat or helmet construction having an electric motor operated fan which is located in the inlet portion of the air flow passage of the vent housing and which is arranged to direct air in downwardly flowing relation through the air flow passage of the vent housing for downwardly directed discharge generally at the forehead of the user so that a flow of air can essentially cover the face of the user for the purpose of cooling.

It is another feature of this invention to provide a novel helmet or hard hat construction having an air blowing system provided with a vent housing having an air inlet having a narrow elongate slot defined in the visor or bill of the helmet and wherein the air flow passage of the vent housing becomes restricted in dimension from the inlet opening to the discharge slot to develop a venturi effect in the flowing air so that air being discharged through the air discharge slot is of greater velocity than air being drawn into the inlet opening by the motor operated fan.

It is another feature of this invention to provide a novel air blowing hard hat or helmet having an electrical system including an electric motor, motor operating circuit, dry cell storage battery and circuit operating switch that enables the user to simply and effectively achieve operation of the air blowing system of the helmet when conditions so warrant.

Briefly, the various objects and features of the present invention are achieved through the provision of a hard hat or helmet construction having a rounded or domed protective shell to provide a protective covering for the head of the user. The protective shell has an internal headband and support strap system for supporting the shell in spaced relation with the head of the user. The rigid protective shell also includes an integral visor or bill which basically provides the helmet or safety hard hat with a sunshade capability. A vent housing is mounted to or formed integrally with the rigid protective domed shell and is located externally of the frontal portion of the domed shell. The vent housing defines a large upwardly directed inlet opening within which is mounted a motorized fan assembly that is operated by an electric circuit including a battery and on/off switch which are both supported by the vent housing structure for easy access by the user. The vent housing further includes a rather broad either flat or slightly curved frontal wall which cooperates with the external curvature of the front portion of the helmet or hard hat shell so as to define a large upwardly directed air inlet opening within which the battery powered motorized fan is located. The electric motor of the rotary fan assembly is engaged for forcing air from the external environment into an internal, downwardly directed channel defined by the vent housing. The vent housing is defined in part by a pair of opposed side walls which extend rearwardly from the frontal wall of the housing and which merge into engaged relation with the front external wall surface of the protective head covering domed shell. The vent housing also has a rear wall projecting upwardly from the domed shell. The frontal wall of the vent housing further cooperates with the forward portion of the head covering shell to define a narrow, elongate vent housing channel which directs downwardly flowing air to and through a narrow elongate air discharge slot which is defined in the visor or bill portion of the helmet construction. This narrow elongate discharge opening may be substantially straight or it may be of curved configuration. Preferably the elongate narrow discharge slot is of slightly curved configuration having a larger curvature as compared to the curvature of the front portion of the head covering shell. Thus, when air is forced by the fan through the discharge opening, a narrow curtain of downwardly flowing air is developed which is directed along the forehead and face of the user for the purpose of providing a cooling flow of air broadly across the face of the user to provide for the comfort of the user and to help minimize the perspiration that may be present on the face of the user while working in an environment of elevated temperature. The vent housing having a rather large inlet opening and having a narrow discharge slot of less dimension than the inlet opening and having a decreasing cross-sectional dimension from top to bottom, causes the development of a velocity of air discharge at the discharge opening that is significantly greater than the velocity of air being drawn into the vent housing by the battery powered electric fan. This feature permits the use of a low powered electric motor to initiate air flow at low velocity and develops a venturi effect within the air flow passage that results in the discharge of air at a velocity exceeding the air flow velocity at the air inlet opening of the vent housing. The upper portion of the vent housing is provided with a vented grill work cover which minimizes the possibility of debris entering the vent housing at the air inlet where it might interfere with operation of the motorized fan or provide for flow of debris along with the air along the face of the user. If desired, the vented grill work cover may also be provided with an internal filter which insures against the presence of dust and other debris in the downward flow of air to the face of the user.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings. In the drawings.

DETAILED DESCRIPTION OF PREFERRED EMBODIMENT

Figure 1:
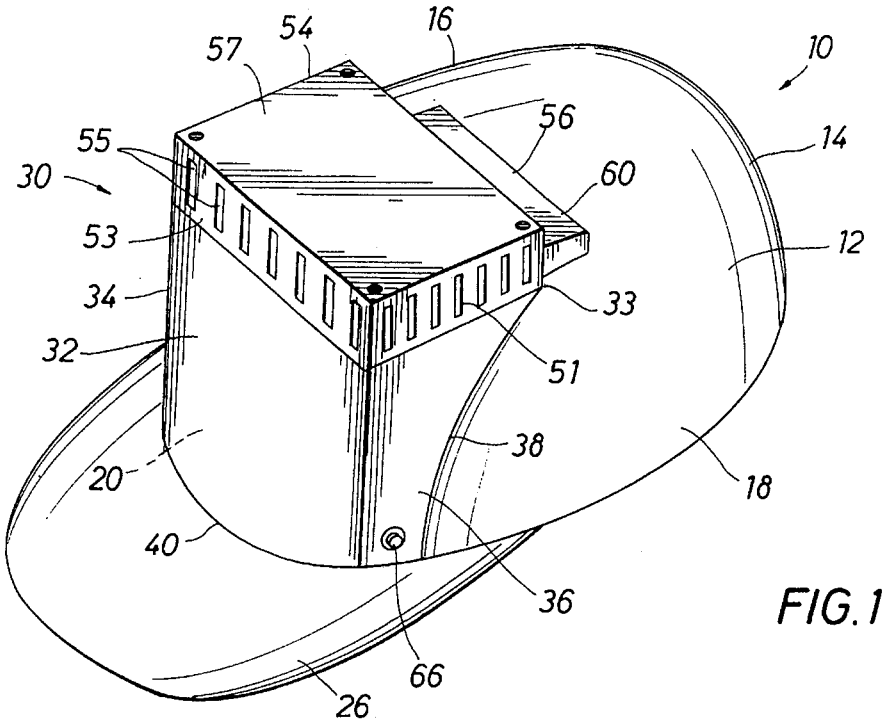
FIG. 1 is an isometric illustration of a safety type hard hat or rigid helmet which is provided with a motorized battery powered air flow cooling system which is constructed in accordance with the teachings of the present invention and represents the preferred embodiment of this invention.
Figure 2:
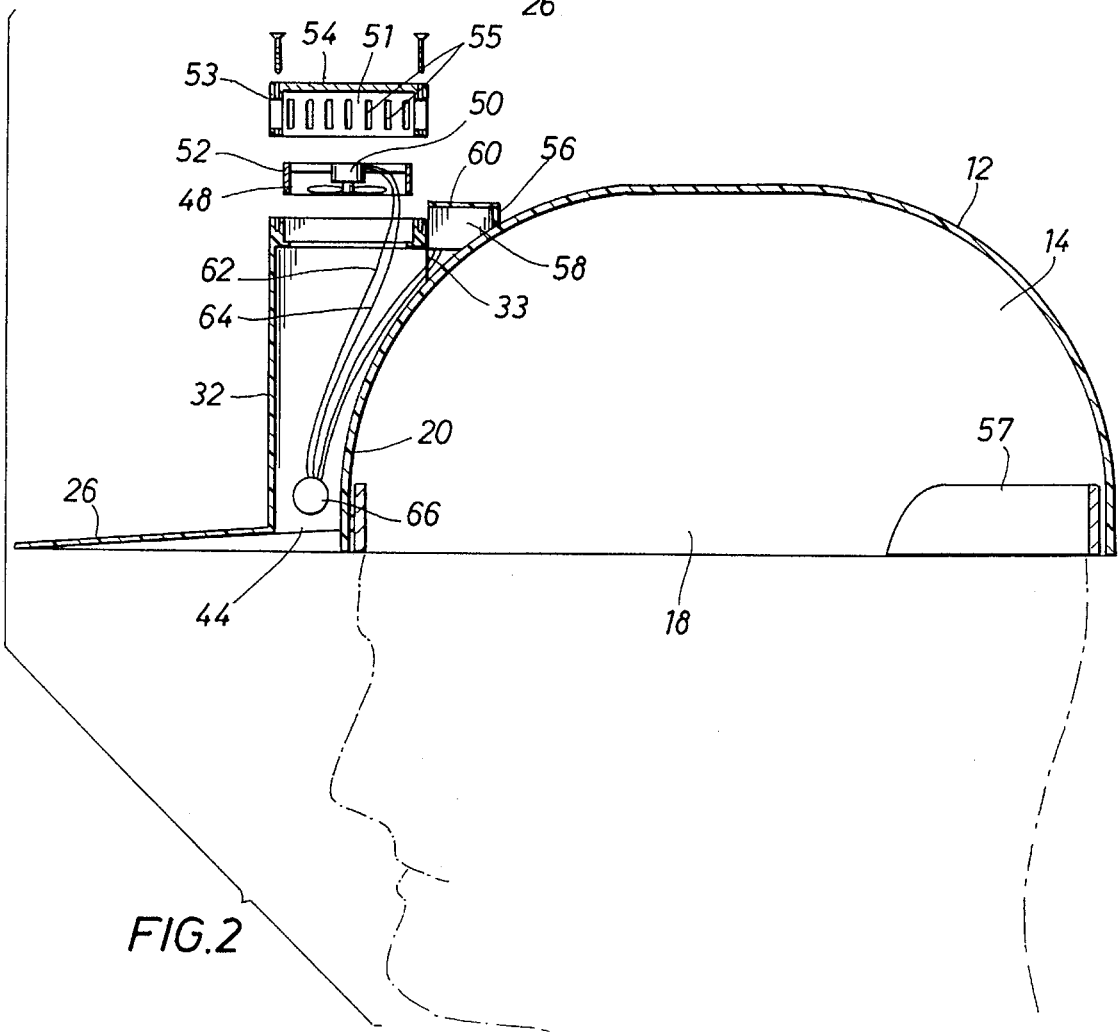
FIG. 2 is a partial side elevational view showing the head of a user and further showing by way of exploded sectional illustration an electric motor driven, battery powered air blowing and directing system for directing a broad curtain of air across the face of the user in accordance with the teachings of this invention.

Referring now to the drawings and first to FIGS. 1 and 2 there is shown an air venting or blowing hard hat or helmet construction generally at 10 having a shell 12 which is of a typical domed configuration, having a rear wall portion 14 curved side wall portions 16 and 18 and a front wall portion 20. The domed shell 12, as is typical of most safety hard hats and helmets, is provided internally with a headband 22 and support straps 24 which are secured to the peripheral portion of the shell by holding means such as rivets, screws or the like. Typically the domed shell is composed of an impact resistant material such as fiberglass or any of a number suitable polymer materials or combinations of materials that give the helmet the capability of withstanding impact forces when not intended as a safety hat or helmet the helmet may be of light-weight construction. A visor or bill 26 is formed integrally with the domed shell and joins the shell at or near the periphery of the helmet such as is evident from FIG. 1.

In accordance with the principal feature of the present invention it is desirable to provide the helmet 10 with means for accomplishing delivery of a volume of air from the helmet and causing it to flow as a broad cooling curtain of air downwardly along the face of the user to provide for dissipation of heat from the face of the user and to minimize the development of perspiration and as well, provide for the comfort of the user. Accordingly, the vent helmet 10 is provided with a vent housing illustrated generally at 30 which includes a substantially flat or slightly curved front wall 32, a pair of side walls 34 and 36 and a rear wall 33. The side walls have curved edges as shown at 38 to merge with the curvature of the domed shell 12. The vent housing 30 is preferably formed as an integrally molded component of the domed shell 12 and visor 26 so that the helmet and vent housing comprise a one piece unit. In the alternative however the vent housing may be provided as a separate unit to be bonded to or otherwise secured to the domed shell. This will prevent the vent housing to be acquired as a separate component and assembled to the helmet structure if desired so that with minor modification existing helmets may be converted to air blowing helmets without departing from the spirit and scope of this invention. The only helmet modification that would be required is cutting the air discharge opening in the visor. The lower portion of the front wall of the vent housing as shown at 40 intersects the upper surface of the visor 26 and is preferably formed integrally with the visor. In the alternative however the front wall 32 may be bonded or otherwise joined at its lower end 40 to the upper surface of the visor 26.

It should be borne in mind that the vent housing 30 cooperates with the front and side portions of the domed shell 12 to define an air conducting channel 34 through which air is directed to the face of the user, while at the same time permitting the domed shell to maintain its designed structural integrity. Thus, the air flow system of the present invention does not alter the force resisting safety characteristics of the domed shell so that the helmet apparatus can maintain its vitality as a safety helmet for workers or for sports spectators and the like. Because of the curvature of the forward portion of the domed shell 12 and the generally rectangular configuration of the front portion of the vent housing 30, the vent chamber or passage 42 has a large, generally rectangular dimension at its upper extremity and a rather narrow dimension at its lower extremity. Thus, the air flow chamber has a gradually diminishing cross-sectional dimension from its top portion to its bottom portion of venturi-like configuration, thereby causing air flow therein to increase in velocity as its progresses toward the lower end of the air flow chamber. Further, at the lower end of the air flow chamber or passage comprising most of the space between the forward surface 20 of the rigid domed shell and the inner surface of the front wall 32, there is defined an air discharge slot 44 which is of substantially the same dimension as compared to the dimension of the lower end of the air flow chamber and will be of less dimension as compared to the dimension of the air inlet opening of the vent housing. Thus, air being forced through the air flow chamber and exiting at the transverse air discharge slot 44 will have an increased velocity at the discharge slot because of the venturi-like configuration of the air flow passage. This enables a relatively low power electrically energized fan to develop sufficient air velocity to provide for efficient cooling of the face of the user.

The upper end of the vent housing 30 is of generally rectangular configuration and defines an internal, generally rectangular seat 46 for an electrically energized fan assembly 48 having an electric motor 50 mounted thereto for driving a rotary fan 49. The fan assembly 48 is typically retained by a plurality of retainer elements such as screws 52 which secure it within the rectangular seat 46 defined by the upper end of the vent housing. The fan assembly 48 is covered by means of a vented cover or grill 54 which serves to prevent large debris from interfering with the fan assembly or entering the air flow passage of the vent housing. The vent housing cover 54 is of generally rectangular configuration to fit about the generally rectangular air inlet opening of the vent housing and to provide a protective cover for the generally rectangular fan assembly 48. For air inlet through the housing cover the cover is provided with side and front walls 51 and 53 which are perforated to define a multitude of inlet openings 55. These inlet openings collectively define an effective inlet opening dimension being near the dimension of the upwardly facing inlet opening of the vent housing. The housing cover 54 typically defines a substantially flat, imperforate upper wall 57 which is provided to protect the fan assembly 48 from being damaged by falling debris. The flat rear wall 59 of the cover 54 is preferably imperforate to prevent debris from entering the vent housing from the rear of the helmet.

Figure 3:
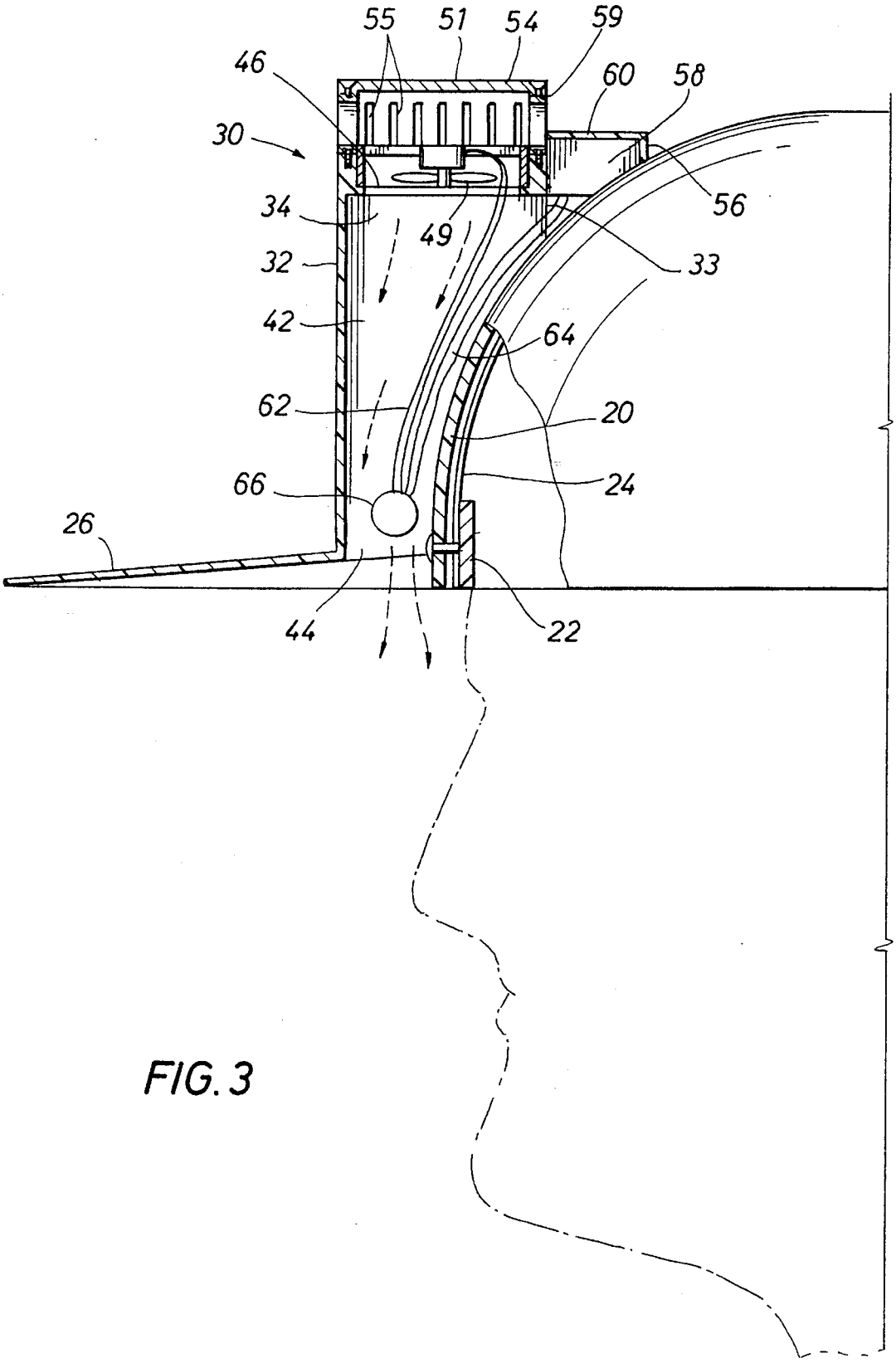
FIG. 3 is an enlarged, partial sectional view of the helmet or hard hat construction of the present invention showing the air blowing system with its vent housing, electric motor operated, battery powered system for blowing air downwardly along the face of a user.

At the rear portion of the vent housing as shown particularly in FIGS. 2 and 3 there is provided a battery receptacle 56 within which is located a dry cell battery 58 such as a 9 volt dry cell battery. The battery receptacle 56 is provided with a battery receptacle cover 60 which secures the dry cell battery 58 within the receptacle and provides protection for the battery and electric circuitry components. The dry cell battery is part of an electrical circuit including electrical conductors 62 and 64 which are connected respectively to the positive and negative polls of the dry cell battery within the battery receptacle. Typically, the battery receptacle is provided with electrical contacts that are engaged by the positive and negative polls of the dry cell battery and the electrical conductors are permanently connected to these electrical contacts. The electrical conductors 62 and 64 are provided with an electrical switch in the form of an on/off button 66 which is typically located within the air flow chamber of the vent housing along with the electrical circuit components. The on/off bottom will then be exposed at one of the side walls 34 and 36, preferably the right side wall 34 as shown in FIG. 3, to permit manually control energization of the electric motor 50 of the fan assembly as desired.

When the fan motor is energized it rotates directionally so as to draw air from the environment through the multitude of inlet openings 55 and to then force the air downwardly through the air flow passage 34 of the vent housing. Since the cross-sectional dimension of the vent housing decreases from top to bottom because of the curvature of the front and forward side portions of the crown section 12, the air flow velocity developed by the motorized fan assembly will increase as the air flows downwardly to the discharge slot 44. At the discharge slot the air flow will be at its highest velocity. Thus, the motorized fan may be of relatively low power but will be capable of achieving significant air velocity at the discharge slot to provide for efficient cooling of the user.

The configuration of the elongate transverse discharge slot 44 may be slightly curved as shown in FIG. 1 or, in the alternative, it may be a substantially, straight narrow slot extending through the visor of the helmet at a location within the air flow chamber or passage 42 as shown in FIG. 3. Thus, as the motorized fan operates a broad curtain of flowing air will be directed through the discharge slot 44 downwardly along the face of the user thereby providing the user's face with a pleasant, cooling flow of air to efficiently provide for the comfort of the user. The discharge slot will extend substantially the entire width of the vent housing at the visor.

For the reason that the vent housing, fan and motor assembly and dry cell battery may cause the helmet to be "front heavy" a counter-balancing weight 57 may be attached internally or externally of the rear portion 14 rigid shell 12 to provide balance for the air blowing helmet assembly so it that will be comfortable to wear. The added weight of the counter balance 57 will not be sufficient to make the helmet heavy because the vent housing and motorized fan components will be of light-weight construction.

To prepare the air blowing helmet of this invention for use the user will simply insert a dry cell battery 58 within the battery receptacle 56 so that the battery contacts are in operative engagement with the contacts of the electrical circuit. At this point, for fan operation the user will actuate the on/off switch to its on position thereby connecting the motor circuit with the battery circuit to drive the fan motor 50. The motor of the fan assembly within will continue to operate until such time as the on/off switch is moved to its off position or the dry cell battery dissipates its charge through motor operation.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A helmet to be worn on the head of a user and having an air blowing system for cooling the face of the user, comprising:

(a) a rigid crown section adapted to provide a protective cover for the head of the user and defining front, rear and side portions;

(b) an adjustable crown support being located within the crown section and having a headband and crown straps for supporting said crown section in spaced relation about the head of the user;

(c) a rigid visor being integral with said crown section and having curved juncture with said front portion of said rigid crown section, said rigid visor defining a narrow elongate air discharge slot located adjacent the juncture of said rigid visor and said front portion of said crown section;

(d) an air flow housing projecting forwardly from said front portion of said crown section and projecting upwardly from said visor and cooperating with said front portion of said crown section and with said visor to define an air flow chamber having a narrow, elongate lower portion directing air for discharge from said air flow chamber through said narrow elongate air discharge slot of said visor, said air flow housing defining an air inlet opening at the upper portion thereof;

(e) a rotary fan having an electric motor being mounted to said air flow housing within said air inlet and being operative to direct a flow of air into said air inlet and through said air flow chamber and through said elongate air discharge slot of said visor for downwardly directed flow along the face of the user; and (f) a battery powered electrical circuit being connected to said electric motor and having an on/off switch for selective energization of said electric motor for operation of said rotary fan (g) said air inlet opening being of greater dimension as compared to the dimension of said elongate air discharge slot of said visor, said air flow chamber being of a configuration for increasing the velocity of air flow developed by said fan such that the velocity of air being discharged through said elongate air discharge slot of said visor by said fan is greater than the velocity of air being moved through said air inlet by said fan.

2. The helmet of claim 1, wherein said air flow housing comprises:

(a) a front wall projecting upwardly from said visor at a location forwardly of said rigid crown section and defining sides; and (b) spaced side walls projecting forwardly from said rigid crown section and being connected to respective sides of said front wall and cooperating with said front wall and said rigid crown section to define said air flow passage.

3. The helmet of claim 1, wherein said air flow housing comprises:

(a) a generally planar front wall projecting upwardly from said visor and defining generally parallel sides;

(b) a pair of generally planar side walls projecting forwardly from said rigid crown section and being connected to respective sides of said front wall, said side walls having curved intersection with said rigid crown section; and (c) said narrow elongate air discharge slot being located in said visor at a location between said rigid crown section and said front wall.

4. The helmet of claim 1, wherein said air flow housing comprises:

(a) a generally planar front wall projecting upwardly from said visor and defining generally parallel sides;

(b) a pair of generally planar side walls projecting forwardly from said rigid crown section and being connected to respective sides of said front wall, said side walls having curved intersection with said rigid crown section;

(c) a generally planar rear wall projecting upwardly from said rigid crown section and being connected to said side walls, said front wall, side walls and rear wall defining an upwardly facing generally rectangular air inlet opening; and (d) said rotary fan being located within said generally rectangular air inlet opening and directing air downwardly through said air flow passage to said narrow elongate air discharge slot.

5. The helmet of claim 4, further comprising:

a fan cover being in assembly with said air flow housing and covering said air inlet opening, said fan cover defining a multiplicity of perforations therein collectively defining an air inlet having a cross-sectional dimension being substantially equal to the cross-sectional dimension of said air inlet opening.

6. The helmet of claim 5, wherein said fan cover comprises:

(a) a generally planar generally rectangular upwardly facing imperforate wall; and (b) generally planar front, rear and side fan cover walls extending downwardly from said imperforate wall and adapted for seating at said air inlet opening, said front, rear and side fan cover walls defining said multiplicity of perforations.

7. The helmet of claim 1, further comprising:

(a) a battery receptacle projecting rearwardly from said air flow housing and upwardly from said rigid crown section and receiving the battery of said battery powered electrical circuit therein; and (b) a battery closure being releasably received by said battery receptacle for securing said battery within said battery receptacle.

8. The helmet of claim 1, wherein said battery powered electrical circuit comprises:

(a) electrical conductors interconnecting said battery receptacle with said electric fan motor; and (b) an on/off switch being coupled within at least one of said electrical conductors and being mounted to said air flow housing and being exposed externally of said air flow housing for manual actuation.

9. An air blowing helmet to be worn on the head of a user and having an air blowing system for directing a cooling curtain of downwardly flowing air along the face of the user, comprising:

(a) a rigid domed crown section adapted to provide an impact resistant protective cover for the head of the user and defining front, rear and side portions;

(b) a rigid visor being integral with said crown section and having curved juncture with said front portion of said rigid crown section, said rigid visor defining a narrow elongate transversely oriented air discharge slot located adjacent the juncture of said rigid visor and said front portion of said crown section;

(d) a generally rectangular air flow housing projecting forwardly from said front portion of said crown section and projecting upwardly from said visor and cooperating with said front portion of said crown section and with said visor to define an air flow chamber having an air inlet opening and a lower portion of less cross-sectional dimension than the cross-sectional dimension of said air inlet opening for directing air for discharge from said air flow chamber through said narrow elongate transversely oriented air discharge slot of said visor;

(e) a rotary fan having an electric drive motor and being mounted to said air flow housing within said air inlet opening and being operative to direct a flow of air into said air inlet and through said air flow chamber and through said elongate air discharge slot of said visor for downwardly directed flow along the face of the user; and (f) a battery powered electrical circuit being connected to said electric motor and having an on/off switch for selective energization of said electric motor for operation of said rotary fan.

10. The helmet of claim 9, wherein:

(a) said air inlet of said air flow housing being of greater dimension as compared to the dimension of said elongate air discharge slot of said visor; and (b) said air flow chamber being of downwardly decreasing cross-sectional dimension for developing a venturi effect increasing the velocity of air flow developed by said fan such that the velocity of air being discharged through said elongate curved air discharge slot of said visor is greater that the velocity of air being moved through said air inlet opening.

11. The helmet of claim 9, wherein said air flow housing comprises:

(a) a front wall projecting upwardly from said visor at a location forwardly of said rigid crown section and defining sides; and (b) spaced side walls projecting forwardly from said rigid crown section domed shell and being connected to respective sides of said front wall and cooperating with said front wall and said rigid crown section to define said air flow passage.

12. The helmet of claim 9, wherein said air flow housing comprises:

(a) a generally planar front wall projecting upwardly from said visor and defining generally parallel sides;

(b) a pair of generally planar side walls projecting forwardly from said rigid crown section and being connected to respective sides of said front wall, said side walls having curved intersection with said rigid crown section; and (c) said narrow elongate air discharge slot being located in said visor at a location between said rigid crown section and said front wall.

13. The helmet of claim 9, wherein said air flow housing comprises:

(a) a generally planar front wall projecting upwardly from said visor and defining generally parallel sides;

(b) a pair of generally planar side walls projecting forwardly from said rigid crown section and being connected to respective sides of said front wall, said side walls having curved intersection with said rigid crown section;

(c) a generally planar rear wall projecting upwardly from said rigid crown section and being connected to said side walls, said front wall, side walls and rear wall defining an upwardly facing generally rectangular air inlet opening; and (d) said rotary fan being located within said generally rectangular air inlet opening and directing air downwardly through said air flow passage to said narrow elongate air discharge slot.

14. The helmet of claim 13, further comprising:

a fan cover being in assembly with said air flow housing and covering said air inlet opening, said fan cover defining a multiplicity of perforations therein collectively defining an air inlet having a cross-sectional dimension being substantially equal to the cross-sectional dimension of said air inlet opening.

15. The helmet of claim 14, wherein said fan cover comprises:

(a) a generally planar generally rectangular upwardly facing imperforate wall; and (b) generally planar front, rear and side fan cover walls extending downwardly from said imperforate wall and adapted for seating at said air inlet opening, said front, rear and side fan cover walls defining said multiplicity of perforations.

16. The helmet of claim 9, further comprising:

(a) a battery receptacle projecting rearwardly from said air flow housing and upwardly from said rigid crown section and receiving the battery of said battery powered electrical circuit therein; and (b) a battery closure being releasably received by said battery receptacle for securing said battery within said battery receptacle.

17. The helmet of claim 9, wherein said battery powered electrical circuit comprises:

(a) electrical conductors interconnecting said battery receptacle with said electric fan motor; and (b) an on/off switch being coupled within at least one of said electrical conductors and being mounted to said air flow housing and being exposed externally of said air flow housing for manual actuation.

18. An air flow housing for assembly with hard hats and helmets having a rigid domed shell and a visor being integral with said rigid domed shell, comprising:

(a) a generally planar front wall adapted for projecting upwardly from said visor at a location forwardly of said rigid domed shell and defining sides;

(b) a pair of spaced generally planar side walls adapted to project forwardly from said rigid domed shell and being connected to respective sides of said front wall and cooperating with said front wall and said rigid domed shell to define an air inlet opening and an air flow passage having an elongate transversely oriented air discharge opening located within said visor and being oriented for discharge of a curtain of flowing air along the face of the user, a generally planar rear wall adapted to project upwardly form said rigid domed shell and being connected to said side walls, said front wall, side walls and rear wall defining an upwardly facing generally rectangular air inlet opening;

(c) a rotary fan having an electric drive motor and being mounted to said air flow housing within said generally rectangular air inlet opening and being operative to direct a flow of air into said air inlet and downwardly through said air flow passage of said air flow chamber and through said elongate air discharge slot of said visor for downwardly directed flow of air through said elongate air discharge slot and along the face of the user; and (f) a battery powered electrical circuit being connected to said electric motor and having an on/off switch for selective energization of said electric motor for operation of said rotary fan.

* * * * *